US005603418A

United States Patent [19]

Tellefsen

[11] Patent Number: 5,603,418

[45] Date of Patent: Feb. 18, 1997

[54] HANGER FOR BABY CARE PRODUCTS

[76] Inventor: Pia Tellefsen, Adventveien 15, N-0281, Oslo, Norway

[21] Appl. No.: 492,029

[22] PCT Filed: Jan. 6, 1994

[86] PCT No.: PCT/NO94/00004

§ 371 Date: Jun. 30, 1995

§ 102(e) Date: Jun. 30, 1995

[87] PCT Pub. No.: WO94/15517

PCT Pub. Date: Jul. 21, 1994

[30] Foreign Application Priority Data

Jan. 6, 1993 [NO] Norway ..... 930024

[51] Int. Cl.[6] ..... A47F 5/08

[52] U.S. Cl. ..... 211/113; 211/118; 211/205; 248/317; 248/318

[58] Field of Search ..... 211/118, 113, 211/205, 70.6, 60.1; 248/317, 318, 339, 341, 213.2

[56] References Cited

U.S. PATENT DOCUMENTS

| | | | |
|---|---|---|---|
| 1,691,123 | 11/1928 | Pajeau | 211/113 |
| 1,914,371 | 6/1933 | Hutt | 211/70.6 |
| 1,937,911 | 12/1933 | Pajeau | 211/113 X |
| 3,395,882 | 8/1968 | Marshall . | |
| 3,885,767 | 5/1975 | Olowinski et al. | 248/222.11 X |
| 4,029,038 | 6/1977 | Pfahl | 248/222.11 X |
| 4,455,692 | 6/1984 | Hegge et al. | 248/222.11 X |
| 4,592,527 | 6/1986 | Karapita | 211/113 X |
| 4,603,507 | 8/1986 | Nelson | 211/113 X |
| 4,770,303 | 9/1988 | Boyd | 211/118 X |
| 5,147,050 | 9/1992 | Cullen | 211/118 |

*Primary Examiner*—Alvin C. Chin-Shue
*Assistant Examiner*—Michael J. Turgeon
*Attorney, Agent, or Firm*—Rodman & Rodman

[57] ABSTRACT

A hanging device for baby care articles and products which has a base member and hanger arms arranged on the base member which project outwardly and downwardly from the base member. The hanger arms having outer depending ends formed with hanger devices which could include hooks, open and closed loops and gripper fingers. The hanger arms also have an outer longitudinal section which is fabricated of a flexible material, manually reformable, to adapt the hanger means of the selected hanger arms to the shape and nature of selected baby care articles and products. A container is also provided which has a substantially vertical main axis and a closable opening for insertion of a paper roll. The container also has an attachment location for a suspension cord on an upper side of the container, and engagement device on an opposite lower side of the container for engagement with the base member.

18 Claims, 2 Drawing Sheets

HANGER FOR BABY CARE PRODUCTS

The present invention relates to a hanger for baby care products, such as containers for soap, powder, and skin preparations and for cloths, towels, etc.

The care (bathing/changing) of an infant under normal circumstances takes place at a changing area in a home, which changing area may be a fixed plate or board, a table or counter or, for example, a changing surface which may be swung out of the way, on a bathinette mounted on a stand. The necessary baby care products such as cloths and towels may be hung on hooks in the immediate vicinity of the changing area, e.g., on hooks on a wall. The other baby care products will generally lie about on the changing table in a random order or disorder.

The purpose of the present invention is to provide a hanger for baby care products which may be suspended near the changing area in such a manner that all of the baby care products may easily be reached from the changing table, and with the aid of which hanger said baby care products are always located in a permanent place and are easy to find or to see.

This is achieved according to the invention by means of the characterizing features disclosed in the characterizing clause of the following independent claim 1, and in the subsequent dependent claims.

Thus, with the present invention there is provided a hanger for baby care products of the type described above, where a base member suspended by a suspension cord is equipped with outwardly projecting hanger arms provided with hanger means in the form of, e.g., hooks, loops or gripper fingers, whereon the various baby care products may be hung up or securely held. For example, cloths and towels may be hung up on said hooks, while containers—preferably tapered inward at their outlet openings—may be placed in said loops or between said gripper fingers for retention thereof with the outlet openings/sprinkler openings/dispenser nozzles oriented downward so as to be-in a position ready for use when they are gripped, and so that the container contents are fed out when pressure is exerted on the container or, alternatively, in the case of powder containers, where the powder is sprinkled out when the container is shaken.

It is apparent from the above that a hanger for baby care products according to the present invention will facilitate the daily care of infants by ensuring that all the baby care products are found in their respective places in the suspended hanger.

The invention will be described in more detail in the following, with reference to an embodiment example of the invention, illustrated in the figures.

In the figures.

Figure 5:
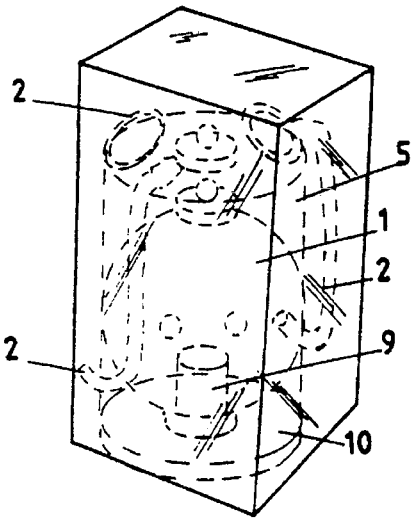
Figure 2:
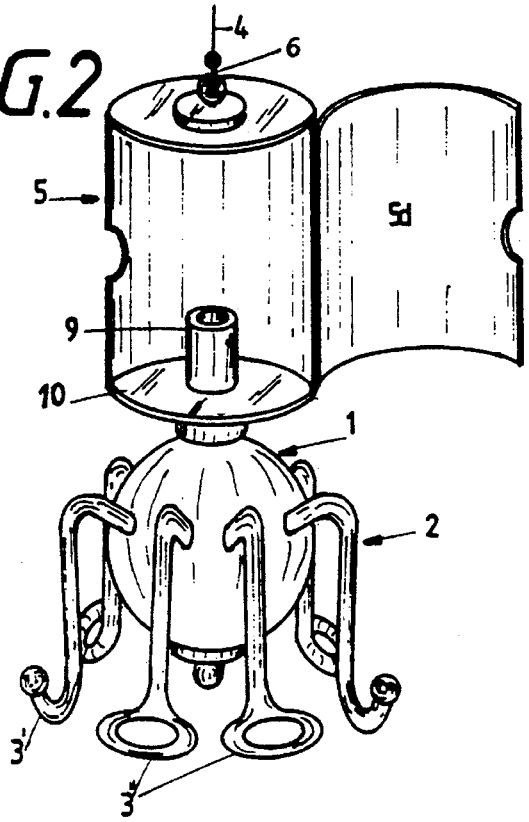
FIG. 2 shows the hanger in assembled state, with the container door open.
Figure 4:
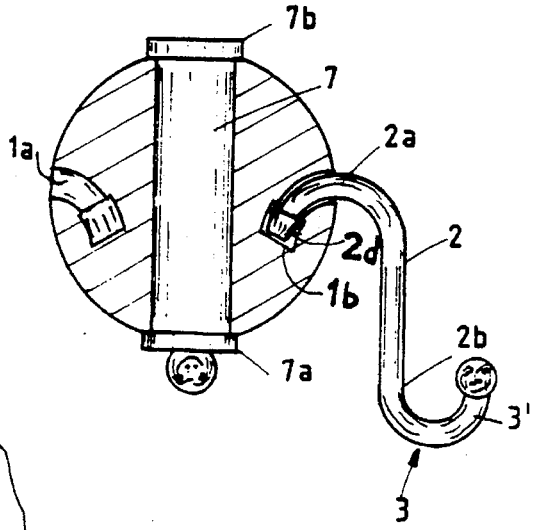

FIG. 4 shows a section of the base member with a through-going hole and shaft located therein, with a stop collar and fastening nut, together with a hanger means in the form of a hook, provided with snap means complementary with snap means in the base member; and FIG. 5 shows the hanger with the base member disposed within the container together with the shaft journal and centering plate, with the hanger arms detached from the base member and the entire unit arranged in a sales package.

Figure 1:
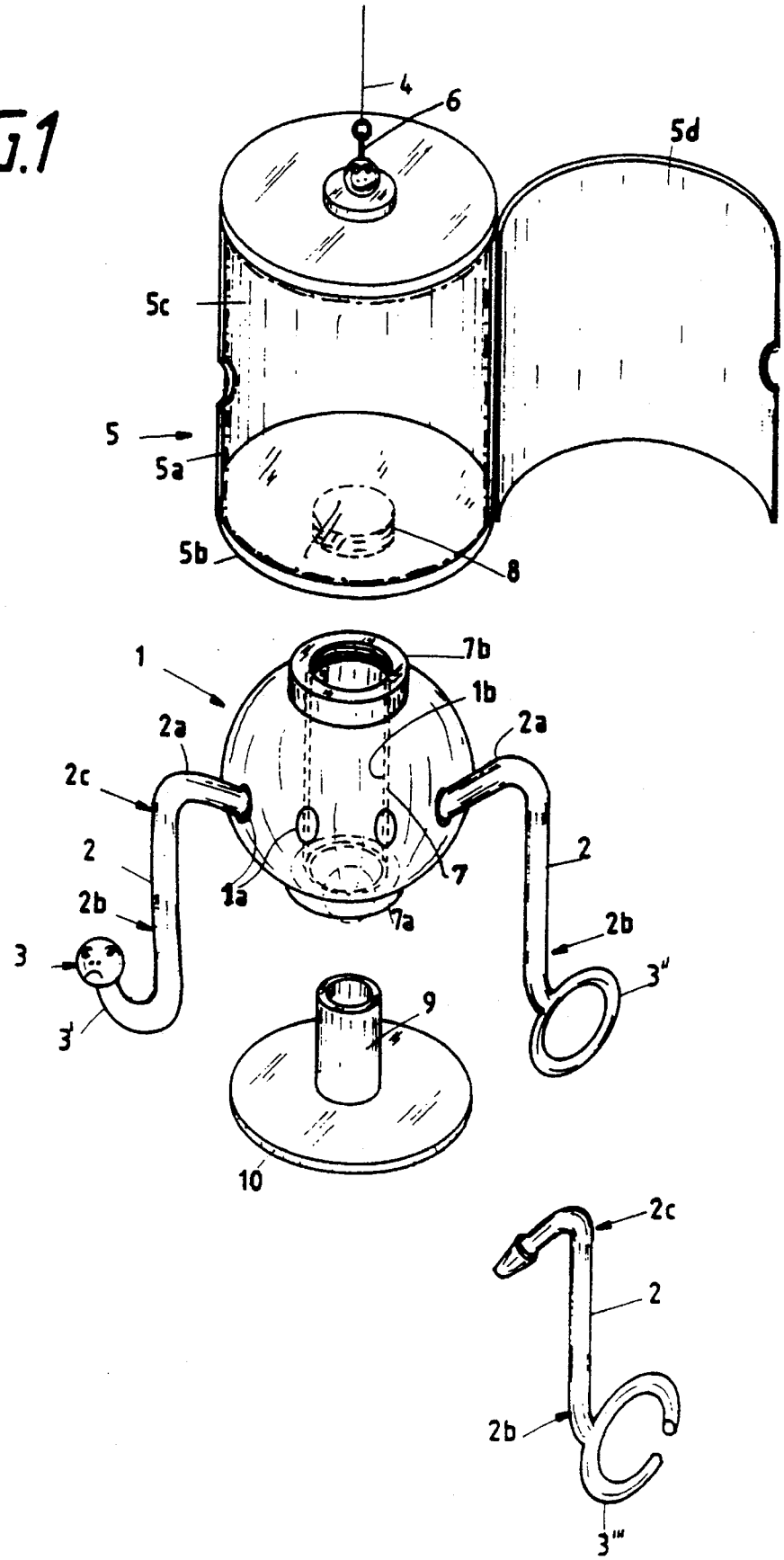
FIG. 1 shows the hanger in perspective with the parts detached from one another, but with two hanger arms attached to the base member.

As shown in FIG. 1, the hanger according to the invention consists of a base member 1, which is preferably spherical, to which are attached, preferably releasably, hanger arms 2 projecting outward and downward from base member 1, which arms are formed with hanger means 3, such as hooks 3', loops 3", gripper fingers 3'" at the outer ends thereof. Base member 1 is adapted for attachment directly or indirectly to a suspension cord 4 depending from a suspension point. Base member 1 is provided with attachment means 1*a*, which preferably are composed of attachment holes for insertion and retention of the inner ends 2*a* of hanger arms 2. Said inner ends 2*a* and attachment holes 1*a* may be provided with complementary snap means, such as shown in FIG. 4, where said inner ends 2*a* are provided with a collar 2*d* for engagement with a corresponding recess 1*b* in attachment hole 1*a*.

The outer longitudinal section 2*b* of hanger arms 2 is preferably fabricated of a flexible, formable material for the adapting of the hanger means 3 to the shape and nature of the various baby care products, and for the forming of hook 3' to an appropriate size and curvature in relation to the cloth, towel, etc., to be hung thereon.

The inner longitudinal section 2*c* of hanger arms 2 is preferably fabricated of a material of stable form in order to attain the desired direction and projection position from base member 1.

As is apparent from FIG. 1, base member 1 is spherical with attachment means la arranged in mutually spaced relationship along the equatorial region thereof.

The spherical base member 1 has a through-going hole 1*b* between the polar regions thereof and a shaft 7, placed in hole 1*b*, having a stop collar 7*a* at one end thereof and a nut 7*b* at the other end thereof for engagement with a threaded connecting piece 8 on the underside 5*b* of a container, which container 5 is positioned in between base member 1 and suspension cord 4. Container 5 is preferably cylindrical and has a door 5*d* in the side wall 5*c* thereof, said door preferably constituting about 180° of the cylindrical side wall 5*c* of the container. Container 5 is designed for insertion of a toilet paper roll, and toilet paper may be extracted through a slot 5*a* between one edge of door 5*d* and the edge of side wall 5*c*. The slot may preferably be provided with a serrated edge.

In the bottom of container 5 there is preferably provided a shaft journal 9 for insertion into the center of the toilet paper roll for guidance of said roll during the extraction of paper through said slot 5*a*.

To facilitate the insertion of the toilet paper roll onto the shaft journal, the latter is preferably positioned on a centering plate 10 for loose placement on the bottom of container 5, which centering plate is held in place by means of the side walls 5*c* and door 5*d* of container 5 in its closed position.

Figure 3:
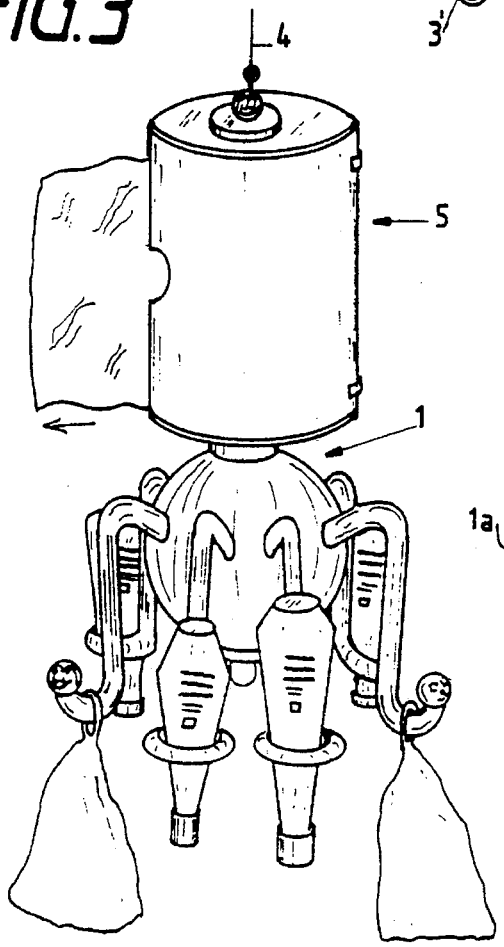
FIG. 3 shows the same as FIG. 2, but with the container door closed and with the various baby care products arranged on the hanger means and in the container, respectively.

FIG. 3 shows the hanger in use with the baby care products in the form of cloths, towels, containers and tubes placed in the hanger means 3 of hanger arms 2, namely hooks 3' and loops 3" (gripper fingers 3'" are not shown here).

As shown in the figure, container 5 and hanger arms 2 may be provided with various types of decoration/ornamentation, and the ends of hooks 3' may be formed as balls/knobs onto which faces are drawn. The same applies, for example, to attachment means 6 on container 5, which may comprise a ball on which a face is drawn. Such a decorative ball may also be placed outside stop collar 7*a* on the shaft 7 running through base member 1, which at the other end thereof is provided with a nut 7*b* for engagement with a threaded connecting piece 8 on the underside 5*b* of container 5.

I claim:

1. A hanging device for baby care articles and products comprising, a base member, hanger arms arranged on the base member and projecting outwardly and downwardly from the base member, said hanger arms having outer depending ends formed with hanger means including hooks, open and closed loops and gripper fingers, said hanger arms having an outer longitudinal section, said outer longitudinal section of selected said hanger arms being fabricated of a flexible material, manually reformable, to adapt the hanger means of the selected hanger arms to the shape and nature of selected baby care articles and products, a container with a substantially vertical main axis and having a closable opening for insertion of a paper roll and, attachment means for a suspension cord on an upper side of said container, and engagement means on an opposite lower side of said container for engagement with said base member.

2. A hanging device according to claim 1 wherein said base member and said container are sized such that said base member can be accommodated within said container with said hanger arms to provide a compact packaging unit.

3. A hanging device according to claim 1 wherein said hanger arms are formed with an inner longitudinal section having an inner end and said base member is provided with attachment means for releasable attachment of the inner ends of said hanger arms.

4. A hanging device according to claim 3 wherein the attachment means on said base member include attachment holes for insertion and retention of the inner ends of the hanger arms.

5. A hanging device according to claim 4 wherein said inner ends of said hanger arms and said attachment holes are provided with complementary snap in engagement means.

6. A hanging device according to claim 1 wherein the inner longitudinal section of said hanger arms is fabricated of a material of fixed stable form that is not manually deformable to a selected shape in order to attain a desired direction and projection position of the hanger arms from the base member.

7. A hanging device according to claim 1 wherein the base member is spherical and the hanger arms are arranged on the base member in mutually spaced relationship along an equatorial region of said base member.

8. A hanging device according to claim 7 wherein the spherical base member has opposite polar regions, and a through going hole between said polar regions, a shaft being placed in said through going hole, said shaft having a stop collar at one end and a nut at the other end, the lower side of said container having a threaded connective piece engageable with said nut to constitute said engagement means.

9. A hanging device according to claim 1 wherein said container is of cylindrical shape and has a semi-cylindrical door constituting approximately 180 degrees of the cylindrical side wall of the container to close the closable opening of said container, the lower side of said container being a lower base, a shaft journal being provided on the lower base of the container for guidance of a toilet paper roll placed within said container during extraction of the paper from the container, said shaft journal being positioned on a centering plate, and said centering plate being sized for loose placement on the lower base of the container and held in place by the side walls of the container and the semi cylindrical door of said container.

10. A hanging device according to claim 9 wherein said base member and said container are sized to permit accommodation of said base member together with said hanger arms in said container to provide a compact package unit, and wherein the spherical base member has opposite polar regions and a through going hole through the polar regions, and wherein the shaft journal on the centering plate is adapted for insertion into at least one of the through holes in the base member to provide said compact package unit.

11. A hanging device for baby care articles and products comprising, a base member, means for suspending the base member from a remote suspension point near a changing table or bassinet for infants, hanger arms arranged on the base member and projecting outwardly and downwardly from the base member, said hanger arms having outer depending ends formed with hanger means including hooks, open and closed loops and gripper fingers, said hanger arms having an outer longitudinal section formed with said hanger means, and the outer longitudinal section of selected hanger arms with open and closed loops being fabricated of a flexible material, manually reformable, to adapt the open and closed loops to the shape and nature of selected baby care articles and products, and, said hanger arms are formed with an inner longitudinal section that connects with and extends from the base member, said inner longitudinal section being formed of a material of fixed stable form that is not manually reformable to maintain a desired direction and projection position of the hanger arms from the base member.

12. A hanging device according to claim 11 wherein the inner longitudinal section of said hanger arms include an inner end and said base member is provided with attachment means for releasable attachment of the inner ends of the hanger arms.

13. A hanging device according to claim 12 wherein said attachment means on said base member include attachment holes for insertion and retention of the inner ends of said hanger arms.

14. A hanging device according to claim 13 wherein said inner ends and said attachment holes are provided with complementary snap-in engagement means.

15. A hanging device according to claim 11 wherein said base member is spherical and said hanger arms are arranged in mutually spaced relationship along an equatorial region of said base member.

16. A hanging device according to claim 15 herein said spherical base member has opposite polar regions and a through going hole between said polar regions, a shaft displaced in said through going hole with a stop collar at one end and a nut at the other end thereof, for engagement with a container.

17. A hanging device according to claim 11 further including a container of cylindrical shape having upper and lower bases and a semi-cylindrical door constituting approximately 180 degrees of the cylindrical side wall of the container to close a closable opening of said container, a shaft journal being provided on the lower base of the container for guidance of a toilet paper roll placed within said container during extraction of the paper from the container, said shaft journal being positioned on a centering plate, said centering plate being sized for loose placement on the lower base of the container and held in place by the side walls of the container and the semi cylindrical door of said container, and means for joining said spherical base member to the upper base of said container.

18. A hanging device according to claim 17 wherein said spherical base member and said container are sized to permit accommodation of said spherical base member together with said hanger arms in said container to provide a compact package unit, and wherein the spherical base member has opposite polar regions and a through going hole through the polar regions, and wherein the shaft journal on the centering plate is adapted for insertion into at least one of the through holes in the base member to provide said compact package unit.

* * * * *